United States Patent [19]

Kent

[11] 4,335,843

[45] Jun. 22, 1982

[54] PARTITIONED STACKING CRATE AND BLANK THEREFOR

[75] Inventor: Ronald I. Kent, La Habra, Calif.

[73] Assignee: Stone Container Corporation, Chicago, Ill.

[21] Appl. No.: 232,666

[22] Filed: Feb. 9, 1981

[51] Int. Cl.[3] ..... B65D 5/48

[52] U.S. Cl. ..... 229/27; 229/15

[58] Field of Search ..... 229/27, 37 R, 15, 42

[56] References Cited

U.S. PATENT DOCUMENTS

| | | | |
|---|---|---|---|
| 2,718,997 | 9/1955 | Shuxteau | 229/27 |
| 2,777,627 | 1/1957 | Crane | 229/27 |
| 3,127,086 | 3/1964 | Crane | 229/27 |
| 3,194,472 | 7/1965 | Crane | 229/27 |
| 3,677,458 | 7/1972 | Gasling | 229/27 |
| 4,018,377 | 4/1977 | Kent et al. | 229/27 |
| 4,228,945 | 10/1980 | Wysocki | 229/27 |

FOREIGN PATENT DOCUMENTS

| | | | |
|---|---|---|---|
| 688275 | 3/1965 | Italy | 229/27 |
| 690785 | 8/1965 | Italy | 229/27 |
| 319418 | 1/1970 | Sweden | 229/27 |

*Primary Examiner*—Herbert F. Ross

*Attorney, Agent, or Firm*—Silverman, Cass & Singer, Ltd.

[57] ABSTRACT

A composite crate is partitioned into at least two compartments having separate bottom walls, wherein each of the compartments has a pair of opposed double-walled end structures upstanding from its bottom wall, and one of the double-walled ends of each of the compartments is positioned in a back-to-back contact, one with the other, to form a divider structure separating the compartments. Each of the compartments further includes a pair of opposed double-walled sides upstanding from its bottom wall.

In the preferred construction, the composite crate can be erected from a single-piece blank of corrugated or solid-fibre paperboard without requiring a conventional manufacturer's joint.

14 Claims, 6 Drawing Figures

Fig. 2
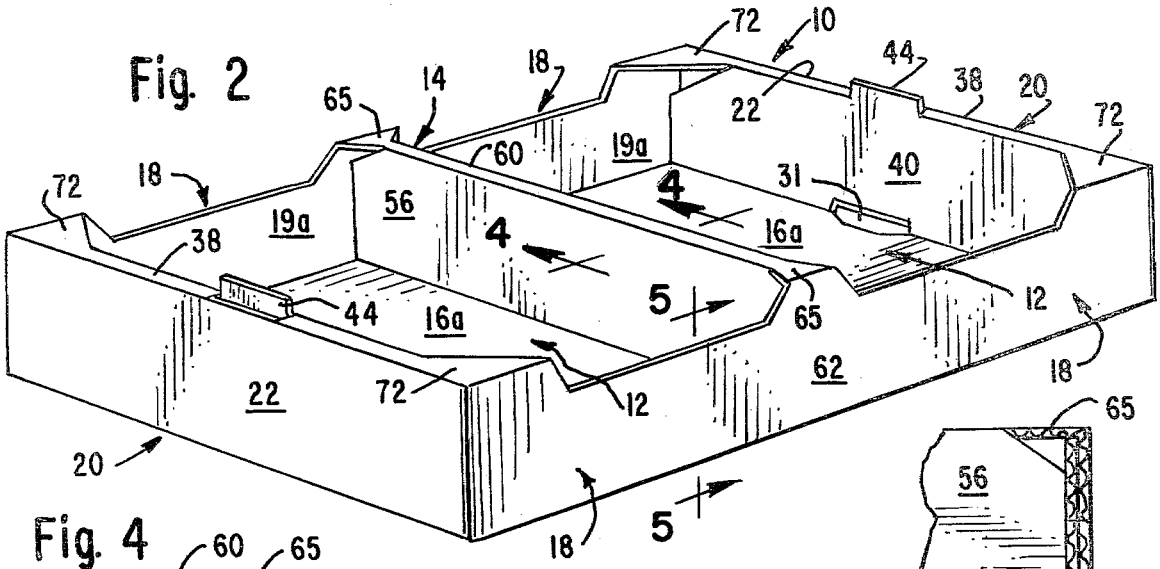
Fig. 4
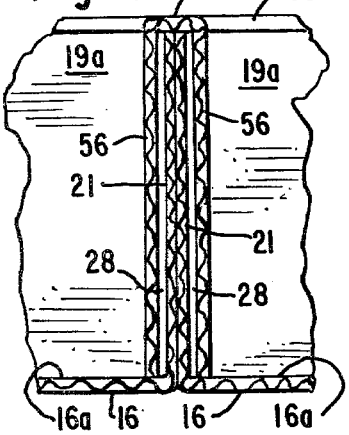
Fig. 5
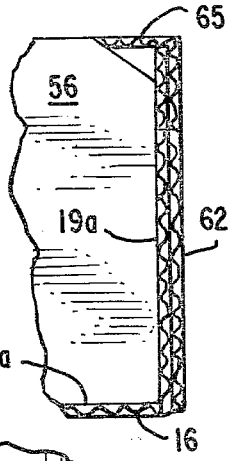
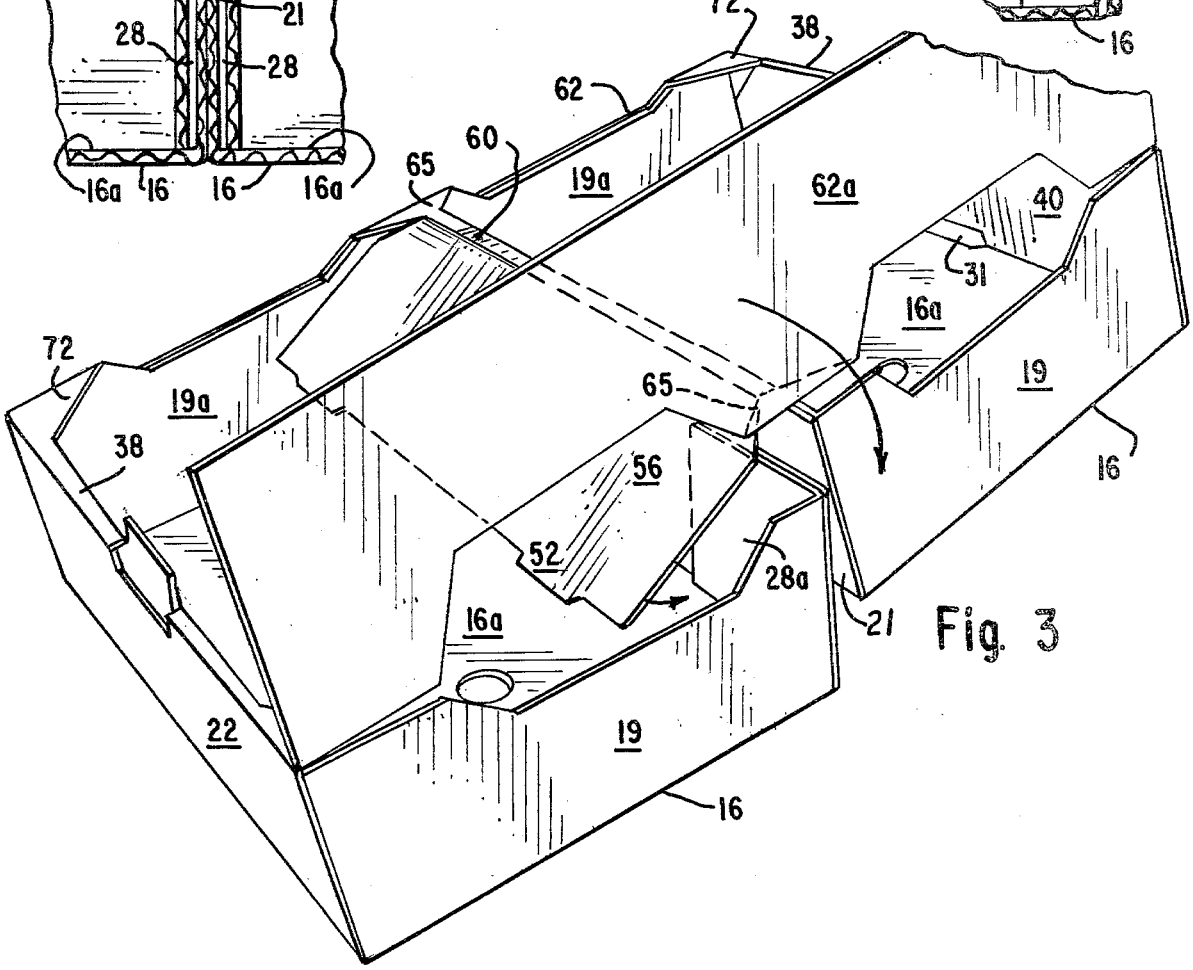
Fig. 3

PARTITIONED STACKING CRATE AND BLANK THEREFOR

BACKGROUND OF THE INVENTION

This invention relates to stacking crates, typically constructed from paperboard for use in containing agricultural produce. More particularly, this invention relates to an improved construction for a composite crate having a pair of compartments for baskets or the like, separated by a divider structure.

Containers for packaging and displaying small fruits and vegetables, such as berries, typically have been constructed from fiberboard or corrugated paperboard crates designed for stacking in warehousing and shipment. Such crates generally include at least two compartments sharing a common bottom wall and partitioned by a divider structure.

Conventionally, the divider structure includes a central panel positioned above the bottom wall and bridging the side walls. In addition to partitioning the crate into compartments, the divider structure is designed to support the bottom wall of a similar crate placed upon the divider structure in a typical stack of loaded crates. When the divider structure is not sufficiently rigid, it can buckle so as to permit damage to the contents, particularly to tender produce, such as berries.

U.S. Pat. No. 4,018,377 describes a partitioned stacking tray having a single bottom wall joined to a side wall by a manufacturer's joint. A central divider panel is provided with a pair of lateral panels extending downwardly to the bottom wall from opposite sides of the central panel. In order to reinforce the support provided by the lateral panels to the central divider panel, each of the lateral panels is provided with a base flap normally fastened to the bottom wall to prevent the bottom wall from sagging under the weight of the contents. The base flaps provide a base for the divider which is disposed between the lateral panels with each base flap extending from the respective lateral panel toward one another. In this construction, however, the central divider panel is vertically supported by only two, separated lateral panels which cannot reinforce each other. Moreover, the common bottom wall of the divided compartments extending as a single expanse, remains vulnerable to sagging from the weight of produce on both sides of the divider.

SUMMARY OF THE INVENTION

According to this invention, a partitioned stacking crate is provided with a divider structure having improved strength by constructing the divider structure from double-walled end structures adjacently upstanding from each of two separate bottom walls of the divided compartments. Back-to-back contact of double-walled ends on each compartment increases the rigidity and strength of the divider structure for stacking the loaded crates. The segmented bottom walls of the compartments eliminate bottom sagging of the loaded crate and facilitate division at the center divider of the crate to form two smaller trays from the compartments for merchandising. Double-walled sides and ends of the crate improve their strength to prevent bulging and provide added protection to food products.

In the preferred construction, the crate can be erected from a single-piece blank of corrugated or solid-fiber paperboard without requiring a conventional manufacturer's joint which must be secured, usually by adhesive in a separate operation.

BRIEF DESCRIPTION OF THE DRAWINGS

FIG. 2 is a perspective view of a composite crate in accordance with this invention, which can be erected from the blank shown in FIG. 1;

FIG. 3 is a perspective view of a partially erected crate of FIG. 2 showing the construction of the divider structure and separable compartments;

FIG. 4 is a cross-section of the divider structure taken along line 4—4 in FIG. 2;

FIG. 5 is a cross-sectional view of a double-walled side structure taken along line 5—5 in FIG. 2.

DESCRIPTION OF THE PREFERRED EMBODIMENT

Figure 1:
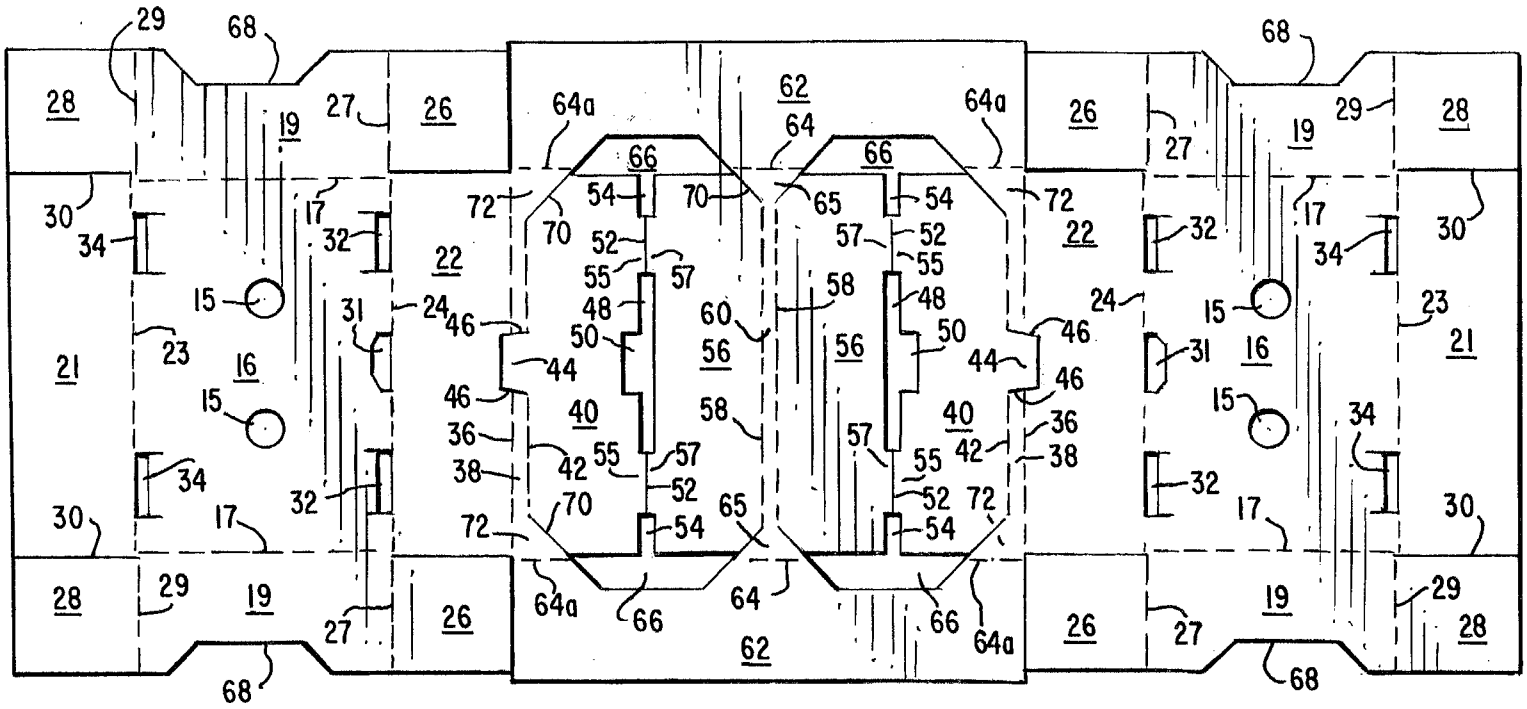
FIG. 1 is a plan view of a single-piece blank formed in accordance with this invention.

Referring to FIG. 2, the erected, composite crate is designated generally by the reference character 10. Crate 10 includes two tray compartments each designated generally by reference character 12. Crate 10 could suitably include more than two compartments 12, with the number of compartments generally governed by convenient handling and stacking of the crate 10 when loaded with fruit produce such as berries. Compartments 12 are separated by a central divider structure 14.

Each compartment 12 includes a bottom wall 16, having ventilating holes 15, a pair of opposing doubled walled sides 18 and a pair of opposing double-walled ends 20. One double-walled end 20 on each of compartments 12 is housed within center divider structure 14 as best shown in FIG. 3 so that the two interior endwall panels 21 are positioned in back-to-back congruent contact when fully erect. The back-to-back construction of the erected interior end wall panels 21 provides suprising strength to the divider 14, particularly under vertical load when the crates 10 containing product are stacked to increasing height, desirable both in warehouse and in shipment. Stength of the divider, provided by reinforcing engagement of the interior end wall panels 21 of compartments 12, not only improves stacking strength of the crate 10 but also prevents sagging of the separate bottom walls 16 in the vicinity of divider 14.

In a preferred embodiment, composite crate 10 can be erected from a single-piece blank 11, as shown in FIG. 1. The material from which the blank 11 can be provided may be any suitably rigid but foldable material. Preferably, blank 11 can be stamped or die cut from a web of corrugated or solid-fiber paperboard.

Figure 6:
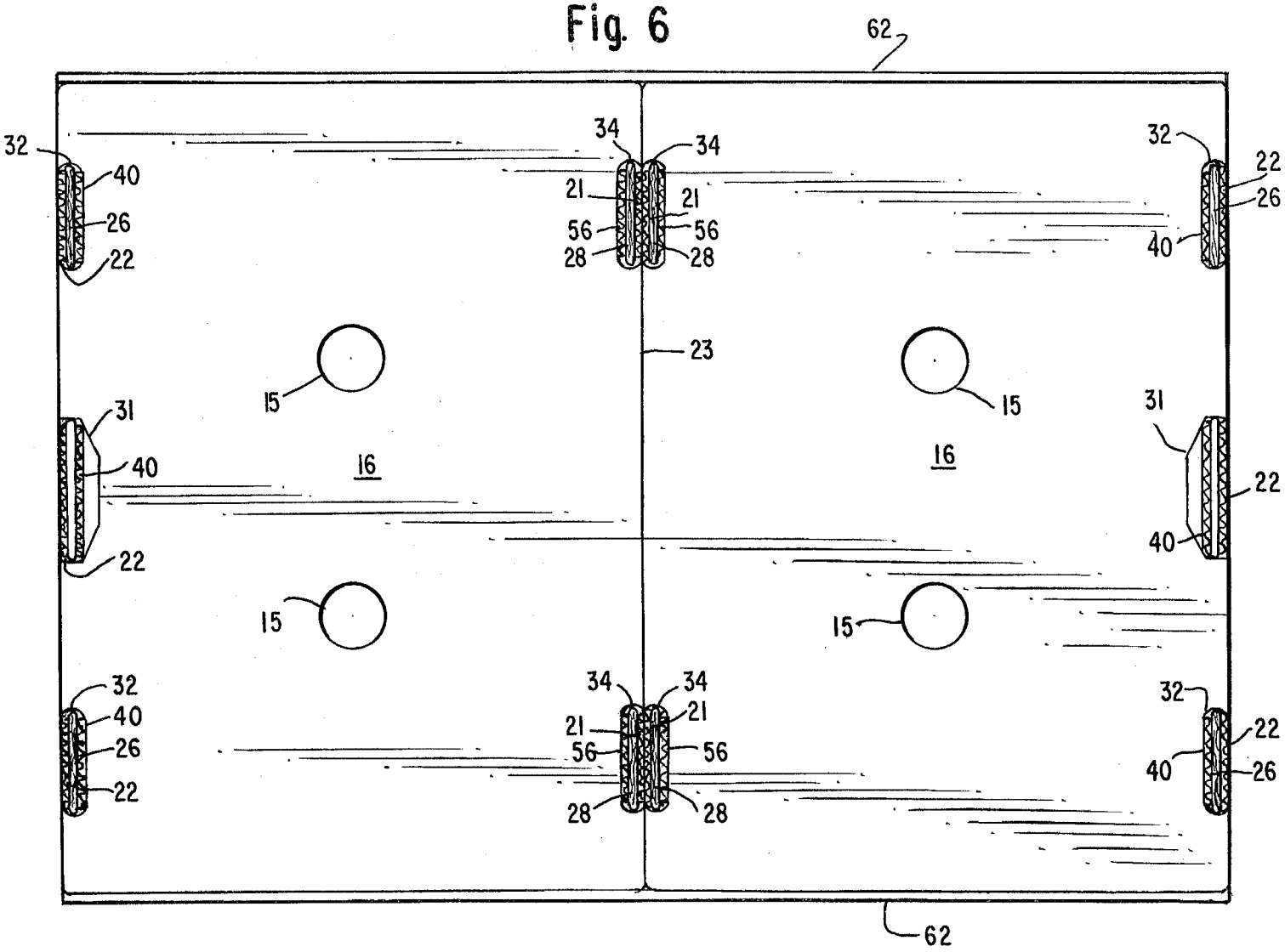
FIG. 6 is a bottom plan view of the erected crate of FIG. 2 showing the pair of segmented bottom walls of the compartments.

Blank 11 is formed in symmetrical configuration as shown in FIG. 1, so that the two bottom walls 16 of respective compartments 12 are at opposite ends of blank 11; thus, each bottom wall 16 is folded backward and inward toward divider structure 14 so that the bottom walls 16 are rotated 180° to position them in a plane parallel to and below the plane of the original blank, with opposite faces **16*a* facing upward upon erection of the crate 10, as illustrated in the bottom plan of crate 10 shown in FIG. 6**.

Referring again to FIG. 1, each bottom wall 16 is integrally hinged by score or fold lines 17 (in dashed representation) to a pair of side panels 19 spaced from one another on opposite sides of bottom panel 16; side panels 19 are folded to form the inner wall of the doubled-walled side structures 18 in the erected crate 10 as shown in both FIGS. 2 and 3. The erected crate in FIG. 2 shows the opposite face 19*a* of side panel 19.

Referring again to FIG. 1, each bottom wall 16 is integrally hinged to interior end wall panel 21 and exterior end wall panel 22 by respective score lines 23 and 24 positioned on opposite edges of bottom wall 16. While each interior end wall panel 21 is housed within divider structure 14 in the erected crate 10 as previously described, exterior end wall panel 22 forms the outer wall of the double-walled end 20 opposingly spaced from the divider 14 as shown in FIG. 2.

Each panel 19 has an exterior end wall flap 26 integrally hinged at score line 27 and a divider wall flap 28 integrally hinged at score line 29 on the opposite edge of sidewall panel 19. While flaps 26 and 28 can be integrally hinged from respective end wall panels 22 and 21, flap 28 is preferably "end cut" along cut lines 30 separating flaps 28 from panel 21 so that flap 28 can contribute to the strength of divider structure 14 by folding along score line 29 into back-to-back contact with panel 21 in the erected crate 10, as more fully described hereinafter.

Each bottom wall 16 further includes a stacking slot 31 positioned preferably midway along score line 24 between a pair of locking slots 32 similarly positioned to interrupt score line 24 promoting its folding. Each bottom wall 16 is further provided with a second pair of locking slots 34 generally aligned with locking slots 32 but located adjacent and interrupting score line 23. In the erected crate 10, locking slots 32 and 34 receive locking tabs formed on wall panels as described hereinafter.

Score line 36 forms the edge on each outer end wall panel 22 spaced opposite score line 24. Each outer end wall panel 22 is integrally hinged by score line 36 to an upper end wall panel; each upper end wall panel 38 is integrally hinged to inner end wall panel 40 along score line 42 forming the edge of upper end wall panel 38 opposite score line 36. Each inner end wall panel 40 forms the inner wall of the double-walled end structure 20 in the erected tray as shown in FIG. 2.

A stacking tab 44, received in the slot 31 of the erected crate stacked above, can be formed as an integral projection from inner end wall panel 40 and defined by cut lines 46 which preferably interrupt both score lines 42 and 36 to extend across upper end wall panel 38 forming a notch in panel 22, as shown in FIG. 1. Each stacking tab 44 is designed for insertion into stacking slot 31 in the erected crate directly above to prevent relevant movement between adjacent crates 10 in a stack. A cut-out 48, including notch 50 is centrally positioned between a pair of cut lines 52 connected to a pair of cut notches 54, which collectively enable complete separation of each inner end wall panel 40 from adjacent divider wall panel 56 in erecting crate 10. Between cut out 48 and each cut notch 54 a pair of opposing locking tabs 55 and 57 separated by cut lines 52 are integrally formed on each inner end wall panel 40 and each divider wall panel 56, respectively.

Each of the divider wall panels 56 is integrally hinged by a respective score line 58 on opposing lateral sides of an upper divider panel 60 having lateral edges defined by the pair of score-lines 58. In the erected crate, upper divider panel 60 and the pair of folded lateral divider panels 56 form divider structure 14 as shown in FIG. 2. The divider structure 14 derives increased support by enclosing the back-to-back pair of interior end wall panels 21 and both pairs of flaps 28, as shown in FIGS. 3 and 4 but not visible in the completely erected crate 10 of FIG. 2.

Upper divider panel 60 bridges a pair of outer sidewall panels 62 integrally hinged by score line 64 at opposite triangular ends 65 of the panel 60; in similar manner, outer sidewall panels 62 are laterally bridged at opposing ends by upper end panels 38 integrally hinged to the ends of each upper end panel 38 defined by extensions 64*a* of score lines 64. Thus, upper divider panel 60 forms a central bridge aligned parallel between upper end panels 38 bridging outer sidewall panels 62. In the erected crate 10, outer sidewall panels 62 form the outer walls of double-walled side structures 18 as best shown in FIGS. 2 and 5.

From each outer side wall panel 62 a pair of cutouts 66 can be positioned such that each cut-out 66 is generally congruent to a recess 68 formed in each inner sidewall panel 19, to provide an expanded side view of the product contents of the erected crate 10. Cut lines 70 can provide both oblique edges on cut-out 66 and edges of generally triangular brace areas 72 formed at each end of upper end panel 38 similar to brace area 65 formed at each end of panel 60.

Blank 11 can be conveniently reduced in length for handling during shipment and storage by folding both of panels 22 backward and inward, along score lines 36, until they flatly overlap to transform the blank into triple thickness.

When the fully extended blank 11, as shown in FIG. 1, is to be erected, each exterior end wall panel 22 is folded back along score line 36 until panel 22 is perpendicular to upper end wall 38; then each bottom wall 16 if folded inward toward one another about score line 24 until each bottom wall panel 16 is perpendicular to the exterior end wall panel 22 and parallel below upper divider panel 60. Next, each pair of opposing flaps 26 and 28 are folded upward toward each other until they are each perpendicular to integrally hinged inner sidewall panel 19; each panel 19 is then folded upward until perpendicular to bottom wall 16, followed by similar upward folding of each interior end wall panel 21 until it is perpendicular to bottom wall 16. At this point, each pair of end wall flaps 28 is in back-to-back, preferably adhesive, contact with interior end wall panel 21, and each pair of exterior end wall flaps 26 is in back-to-back, preferably adhesive, contact with outer end wall panel 22.

To complete the erection of each double-walled end structure 20 shown in FIG. 2, each inner end wall panel 40 can be folded downward along score line 42 to enclose flaps 26 when locking tabs 55 are securely received in slots 32. In similar manner, the erection of divider structure 14 as shown in FIG. 2 can be completed by folding each divider wall panel 56 downward along score line 58 to enclose both pairs of divider wall flaps 28 and the back-to-back interior end wall panels 21 when locking tabs 57 are securely received in locking slots 34 of each bottom wall 16. Thus, in the two sections below brace areas 65 housing flaps 28, the divider structure 14 has 6-paneled thickness and strength as shown in FIGS. 3, 4 and 6.

Erection of double-walled side structure 18 is completed by folding outer side wall panels 62 downward about score lines 64 until each panel 62 is in back-to-back contact with the aligned inner sidewall panels 19 erected from bottom walls 16 as shown in FIGS. 2 and 3. Preferably the contact between each panel 62 and aligned panels 19 is maintained by application of an adhesive.

When composite crate 10 is fully erected as shown in FIG. 2, the double-walled thickness of the side and end walls of each compartment prevent bulging and provide added protection to food products, such as delicate berries. The improved divider structure and segmented bottom provide increased stacking strength, height and shipment payload as well as further protecting the food products by elimination of bottom wall sagging.

Segmented bottom walls also allow facilitated division of the erected crate at the center divider to form two smaller trays from the compartments; such division can be particularly facilitated by minimizing or omitting the non-essential gluing between the interior end panels 21 of the divider structure and by "perfing" a division line on the central divider panel 60 (not shown).

While crate 10 is preferably erected from the singlepiece blank 11, suitable construction modifications can be made to enable erection of crates similar to that shown in FIG. 2 from a two or three piece blank; for example, two separate trays can be provided with locking structure to integrate them into a composite crate, preferably within a larger tray. Further, the crate may be erected from a single-piece blank in which the separated bottom walls for the individual compartments are provided by an integral segment of the blank folded in a reverse relationship to form the bottoms for the trays and the remainder of the blank is folded to provide the end and side wall members and the center divider structure which separates the two trays. This crate would be formed in a so-called "up-side-down"-manner as compared to the preferred embodiment 10. Accordingly, variations from the embodiments described and shown in the drawings can be designed within the scope of the claimed invention.

I claim:

1. A foldable blank of paperboard material having a plurality of hingedly connected panels for erecting a composite crate having at least two compartments, comprising:

A. A pair of bottom panels spaced from one another, for forming separate bottom walls of said compartments;

B. a first and a second end panel extending from opposed sides of each of said bottom panels for forming end walls of each of said compartments;

C. a first and a second side panel extending from opposed sides of each of said bottom panels, for forming side walls of each of said compartments; and D. a central divider panel and a pair of lateral panels extending from opposite sides of the central divider panel, positioned between said bottom panels for forming a divider structure separating said compartments in the erected crate such that each of said lateral panels can be folded into substantially back-to-back, enclosing relationship with a respective one of said end panels erected from each of said bottom panels.

2. A blank as claimed in claim 1, further comprising a pair of outer side panels extending from opposite ends of said central divider panel, each outer side panel forming an outer sidewall in back-to-back contact with at least one of said side panels erected from said bottom panel in the erected crate.

3. A blank as claimed in claim 2, wherein each outer sidewall panel can be folded into back-to-back contact with aligned side panels erected from both of said bottom panels in the erected crate.

4. A blank as claimed in claim 1 or 2, wherein one of said end panels extending from each of said bottom panels is spaced for folding into back-to-back contact, one with the other, for supporting enclosure within said divider structure in the erected crate.

5. A blank as claimed in claim 1, 2 or 3, further including:

a divider wall flap integrally hinged on at least one of said side panels and separated from one of said end panels by a slit line, said flap forming a corner of said blank.

6. A blank as claimed in claim 5 wherein, one of said flaps is integrally hinged on each of said side panels, each of said flaps forming one of four corners of a substantially rectangular configuration of said blank.

7. A blank as claimed in claim 1, 2, or 3 wherein:

each of said bottom panels includes a pair of locking slots located on said side of said bottom panel adjacent said end panel enclosed within said divider structure in the erected crate, said locking slots positioned for receiving a pair of locking tabs projecting from each of said lateral panels, when said crate is erected from said blank.

8. A composite crate erected from the blank as claimed in claim 1, 2 or 3.

9. A composite crate erected from the blank as claimed in claim 4.

10. A composite crate erected from the blank as claimed in claim 5.

11. A composite crate having at least two compartments, wherein each compartment comprises:

A. a bottom wall;

B. a pair of opposed double-walled sides upstanding from said bottom wall;

C. a pair of opposed double-walled ends upstanding from said bottom wall; and wherein one of said double-walled ends of each of said compartments is positioned in back-to-back contact, one with the other, to form a divider structure of two double-walled ends in back-to-back contact separating said compartments.

12. The composite crate as claimed in claim 11, further comprising: a central divider panel joining the upstanding lateral edges of said back-to-back double-walled ends to form a top on said divider structure.

13. The composite crate as claimed in claim 12 in which said bottom walls are physically separated one from the other.

14. The composite crate as claimed in claim 12 in which said bottom walls are integral one with the other.

* * * * *